US006532857B1

(12) United States Patent
Shih et al.

(10) Patent No.: US 6,532,857 B1
(45) Date of Patent: Mar. 18, 2003

(54) CERAMIC ARRAY ARMOR

(75) Inventors: Chienchung James Shih, Artesia; Marc A. Adams, Sierra Madre, both of CA (US)

(73) Assignee: Ceradyne, Inc., Costa Mesa, CA (US)

( * ) Notice: Subject to any disclaimer, the term of this patent is extended or adjusted under 35 U.S.C. 154(b) by 0 days.

(21) Appl. No.: 09/569,429

(22) Filed: May 12, 2000

(51) Int. Cl.[7] ..... F41H 5/02
(52) U.S. Cl. ..... 89/36.02; 89/36.04
(58) Field of Search ..... 89/36.02, 36.01; 109/78, 80, 49.5

(56) References Cited

U.S. PATENT DOCUMENTS 4,307,140 A * 12/1981 Davis
4,323,000 A * 4/1982 Dennis et al.
4,739,690 A * 4/1988 Moskowitz
4,928,575 A * 5/1990 Smirlock et al.
5,170,690 A * 12/1992 Smirlock et al.
5,191,166 A * 3/1993 Smirlock et al.
5,200,256 A * 4/1993 Dunbar
5,254,383 A * 10/1993 Harpell et al.
5,333,532 A * 8/1994 Smirlock et al.
5,402,703 A * 4/1995 Drotleff
5,469,773 A * 11/1995 Tarpinian
5,480,706 A * 1/1996 Li et al.
5,560,971 A * 10/1996 Emery
5,635,288 A * 6/1997 Park
5,686,689 A * 11/1997 Snedeker et al.
5,705,764 A * 1/1998 Schade et al.
5,996,115 A * 12/1999 Mazelsky

* cited by examiner

*Primary Examiner*—Michael J. Carone
*Assistant Examiner*—Troy Chambers
(74) *Attorney, Agent, or Firm*—Leonard Tachner

(57) ABSTRACT

A light-weight armor hard-face component with elastomer encapsulation and lateral confinement to effectively improve multi-hit performance. The preferred embodiment is an integrated package consisting of a large elastomer plate, which contains confined, shock isolated ceramic tiles. This plate can be formed to a variety of sizes and shapes by cutting the elastomer along the gap between ceramic tiles. The attachment of this integrated package to a vehicle structure can be easily accomplished by bolting or adhesive bonding. Elastomer encapsulation limits lateral damage, increases ballistic efficiency and allows multiple impacts without ballistic performance degradation. The armor component is an integrated package, containing a continuous elastomer phase around segmented ceramic tiles. The elastomer is used to (1) attenuate stress waves, (2) accommodate the lateral displacement of ceramic fracturing, and (3) isolate adjacent tiles during the backing vibration stage. Polysulfide possesses adequate dynamic properties for use as the encapsulation component. At high strain rates, the polysulfide exhibits the desired rubber behavior, and its mechanical properties maintain the structural integrity of the whole system. In order to provide resistance to all hostile battlefield environments, multiple layers of different elastomers may be used. The surface rubber can provide an excellent resistance against road hazards, fire, gasoline, etc. The interior rubber, which surrounds the ceramic tiles, has the dynamic properties required to protect the tile adjacent to a hit tile.

20 Claims, 5 Drawing Sheets

CERAMIC ARRAY ARMOR

BACKGROUND OF THE INVENTION

1. Field of the Invention

The present invention relates generally to ceramic armor used for preventing the penetration of structures by high speed projectiles. The invention relates more specifically to an improved ceramic array armor that provides penetration prevention against multi-hit high speed projectiles.

2. Background Art

Ceramic-faced armor systems are capable of defeating armor piercing projectiles by shattering the hard core of the threat in the ceramic component and terminating the fragment energy in the backing component. After impact, the armor system is damaged. In order for the armor to be capable of defeating subsequent hits with a given proximity to previous hits, the size of the damaged zone must be controlled. In armor systems containing an array of ceramic tiles, cracks cannot propagate from one tile to another if the material between the tiles has an effective impedance much lower than the ceramic. Stress waves can still damage tiles adjacent to an impacted tile by (1) stress wave propagation through the inter-tile material and into the adjacent tiles (2) rapid lateral displacement of ceramic debris from the impacted tile, and (3) the deflection and vibration of the backing material.

Ceramic containing armor systems have demonstrated great promise as reduced weight armors. These armor systems function efficiently by shattering the hard core of a projectile during impact on the ceramic material. The lower velocity bullet and ceramic fragments produce an impact, over a large "footprint", on a backing plate which supports the ceramic plates. The large footprint enables the backing plate to absorb the incident kinetic energy, through plastic and/or viscoelastic deformation, without being breached.

Most studies of ceramic armors have only investigated single-hit conditions. Interest in ceramic armors, which can protect against multiple hits over small areas of the armor, has been growing.

The challenge to developing multi-hit ceramic armor is to control the damage created in the ceramic plates and the backing plate by the threat impulse. The ability to defeat subsequent hits, which are proximate to previous hits, can be degraded by (1) damage to the ceramic or backing around a prior hit and/or (2) loss of backing support of tile through backing deformation. Early in the impact event, this damage can be created by stress wave propagation from the impact site. Later in the event, the entire armor panel becomes involved with a dynamic excitation from the threat impulse, vibrating locally at first and later the entire panel moving in a fashion similar to a drumhead. This later response of the panel to the threat impulse can cause further damage to the armor system, often remote from the impact site. The later time excitation of the panel is dependent on the support or attachment conditions of the panel. Hence, the development of multi-hit ceramic armors requires consideration of the panel size and the support condition of the panel.

The motivation for this invention comes from the increasing needs for low-cost, mass producible, robust armor system which exhibit exceptional multiple-hit performance, have reliable attachment and show excellent resistance to all hostile environments. The damage produced in ceramic hard face components by projectile impact can be classified into (1) a comminution zone of highly pulverized material in the shape of a conoid under the incident projectile footprint, (2) radial and circumferential cracks, (3) spalling, through the thickness and lateral directions by reflected tensile pulses, and (4) impact from comminuted fragments. Crack propagation is arrested at the boundaries of an impacted tile if the web between the tiles in the tile array is properly designed. However, stress wave propagation can occur through the web and into the adjacent tiles and can still damage the adjacent tiles.

The lateral displacement of ceramic debris during the fracturing of an impacted tile can also damage the adjacent tiles, reducing their capability to defeat a subsequent projectile impact. At late-time, threat impact induces bending waves in the backing material. These bending waves can cause (1) permanent plastic deformation of the backing plate which degrades the support of adjacent tiles, (2) bending fracture of adjacent ceramic tiles, or (3) eject the ceramic tiles from the backing plate.

SUMMARY OF THE INVENTION

Stress waves can be attenuated rapidly in viscoelastic materials and in the present invention a continuous elastomeric material surrounding all ceramic tiles is an efficient absorber of the stress waves emanating from the impacted tile. The stress wave propagation in the elastomer filled inter-tile area is determined by the elastomer's dynamic impedance, which is a function of the strain rate. Unlike metals or ceramics, elastomers (rubbers) can undergo time dependent, recoverable deformations of 5,000% to 10,000% without mechanical failure. They can be stretched 5 to 10 times their original length and, after removal of the stress, retract rapidly to near their original dimensions with no induced damage. This viscoelastic behavior is strongly dependent on the temperature and the strain rate. At low temperatures and/or high strain rates, elastomers display an elastic mechanical behavior, similar to inorganic glasses. At high temperatures and/or low strain rates, elastomers behave like viscous liquids. It is important to select an elastomer exhibiting the rubber behavior, i.e., in the transition zone between glassy and viscous flow states, at high strain rates ($10^2$ to $10^4$ $s^{-1}$) and at the temperature corresponding to the ballistic events.

By using elastomer-encapsulation around the ceramic tiles, the ceramic damage zone can usually be limited to the impacted tile. Impacts near to the edge of a tile may produce some damage in the immediately adjacent tile. In the tile array, lateral self-confinement in the impacted tile is created by the surrounding tiles. This self-confinement enhances the resistance to penetration by increasing the "friction" between the projectile and the fragmented rubbles.

The present invention comprises a new, light-weight armor hard-face component with elastomer encapsulation and lateral confinement to effectively improve the multi-hit performance. The preferred embodiment is an integrated package consisting of a large elastomer plate, which contains confined, shock isolated ceramic tiles. This plate can be formed to a variety of sizes and shapes by cutting the elastomer along the gap between ceramic tiles. The attachment of this integrated package to a vehicle structure can be easily accomplished by bolting or adhesive bonding.

The key approach of this invention is to use elastomer encapsulation to limit lateral damage, to increase ballistic efficiency and to allow multiple impacts without ballistic performance degradation. The armor component is an integrated package, containing a continuous elastomer phase around segmented ceramic tiles. The elastomer is used to (1)

attenuate stress waves, (2) accommodate the lateral displacement of ceramic fracturing, and (3) isolate adjacent tiles during the backing vibration stage.

Polysulfide possesses adequate dynamic properties for use as the encapsulation component. At high strain rates, the Polysulfide exhibits the desired rubber behavior, and its excellent mechanical properties maintain the structural integrity of the whole system. In order to provide excellent resistance to all hostile battlefield environments, multiple layers of different elastomers may be used. The surface rubber can provide an excellent resistance against road hazards, fire, gasoline, etc. The interior rubber, which surrounds the ceramic tiles, has the dynamic properties required to protect the tile adjacent to a hit tile.

The module bonding process requires an elastomer bonding process to assemble large panels from small modules. A few standard module sizes, e.g. 4×4 tile module, can be manufactured first. The large panels can be fabricated through bonding these individual standard modules to the backing plate and covering the backing plate like a puzzle. However, the final large panel will not have a continuous spall shield. The spall shield plays an important role in restraining flying fragments in front of the armor. The flying fragment may cause a secondary injury to near-by personnel. A discontinuous spall shield may not be efficient in containing the ceramic fragments. One option is applying a continuous spall shield after the modules are bonded onto the backing. The effects of the discontinuous front-face spall shield and the trade-off of the post process for the continuous spall shield would have to be considered. The module cutting process utilizes a splicing device to slice a big module along the rubber gap, without damaging the ceramic tiles. This approach provides the flexibility for the attachment of custom shapes in the field, and may be convenient for field repairs.

It is anticipated that the large-scaled armor packages implemented in accordance with the invention can be used for stand-alone applique armors, structural armors, ceramic components mounted to a thick vehicle hull as an armor upgrade, vehicle skirts, hard-face armor components in other armor systems and stand-alone+semi-flexible armors.

In another embodiment of the present invention shock propagation is further attenuated by employing a plurality of corner shims.

OBJECTS OF THE INVENTION

It is therefore a principal object of the present invention to provide an improved tile array ceramic armor wherein each such tile is encapsulated in an elastomer to increase resistance to multiple projectile hits.

It is another object of the invention to provide an improved ceramic tile array armor wherein an elastomer encapsulation contains and confines each such tile to limit lateral damage, increase ballistic efficiency and enable defeat of multiple impacts.

It is yet another object of the invention to provide an elastomer-encapsulated tile array armor wherein a plurality of divider shims at the tile corners helps to control shock propagation from the impacted tiles to adjacent tiles.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF THE INVENTION

Figure 1:
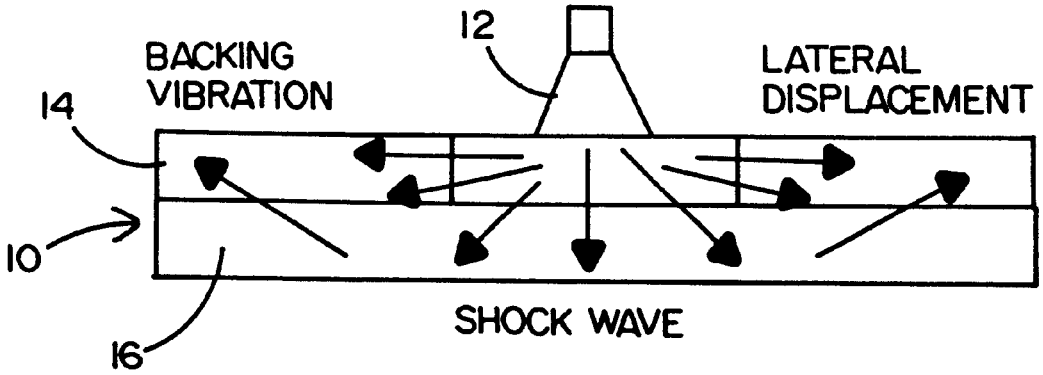
FIG. 1 is a simplified representation of a conventional tile-array armor configuration under impact.
Figure 2:
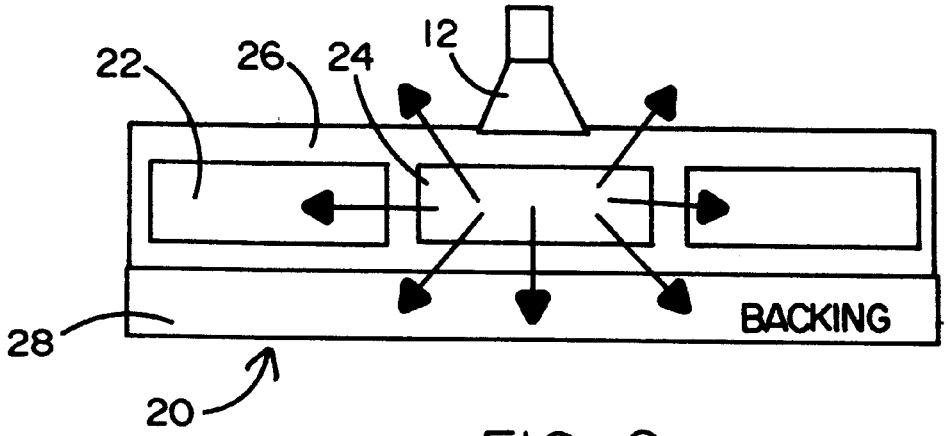
FIGS. 2–4 are simplified representations of the inventive tile-array armor configuration under impact and illustrating the advantageous features thereof.
Figure 3:
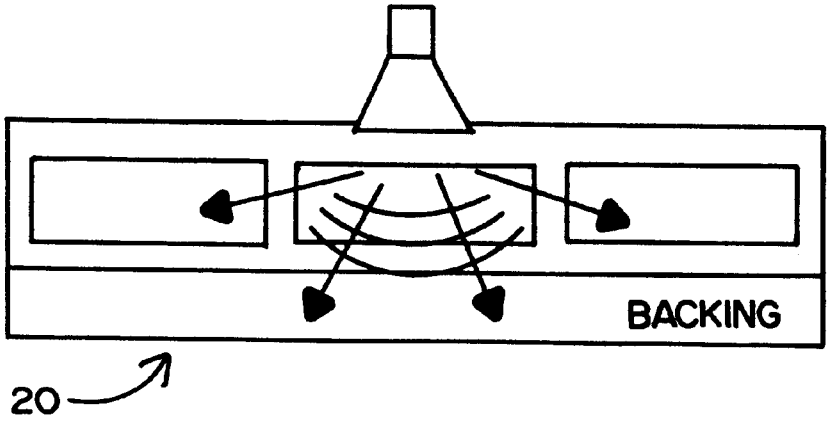

Referring to the accompanying drawings, it will be seen that in a contemporary tile array armor configuration 10 of FIG. 1, the ceramic tiles 14 are in intimate contact and are attached to a backing plate 16. When impacted by a projectile 12, the tile that is hit by the projectile, sends out shock waves that are transmitted relatively unattenuated to the adjacent tiles and to the backing. Moreover, lateral displacement of the tile hit by the projectile and backing vibration induced by the initial impact, also tend to damage the adjacent tiles. Such unattenuated shock waves, lateral displacement and backing vibration-induced displacement cause substantial damage rendering the array more susceptible to penetration by a following projectile forming a multi-hit scenario.

In a first embodiment of the invention shown in FIGS. 24, an elastomer encapsulated tile array 20 has a plurality of tiles 22 individually surrounded by elastomer 26 which separates the tiles from each other as well as from backing 28. Consequently, when projectile 12 impacts center tile 24, the shock waves directed toward adjacent tiles and toward the backing, are significantly attenuated thereby reducing damage thereto. Moreover, the elastomer accommodates lateral displacement and permits controlled tile floating during backing vibration induced by the initial projectile impact while minimizing damage to adjacent tiles and to the backing.

Figure 5:
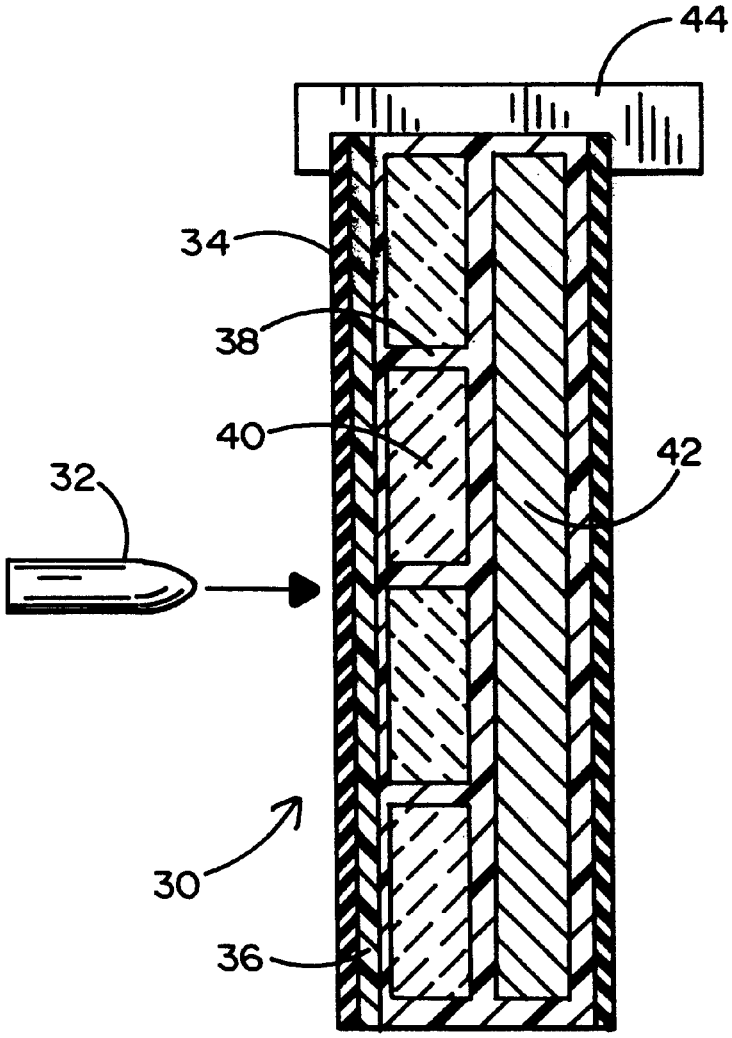
FIG. 5 is a cross-sectional view of a skirt armor structure configured in accordance with an embodiment of the invention.
Figure 6:
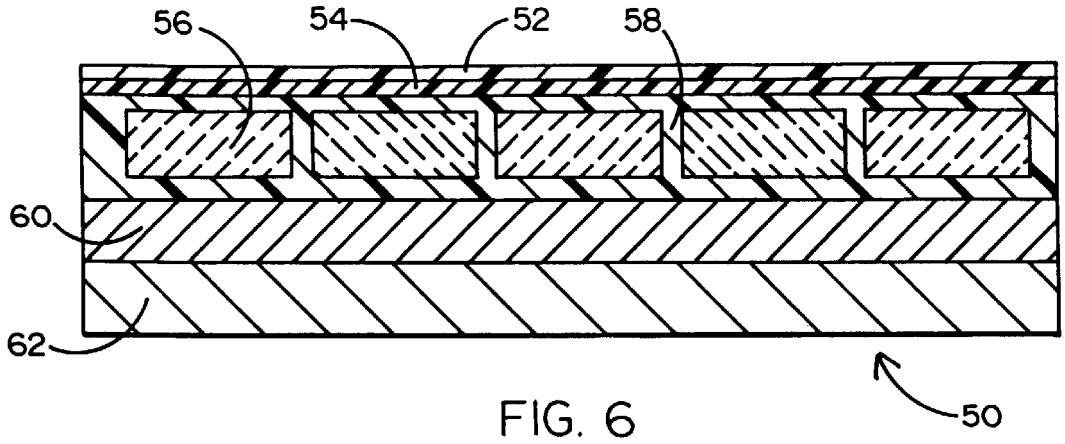
FIGS. 6–8 are cross-sectional views of three alternative embodiments of side armor structures configured in accordance with respective embodiments of the invention.
Figure 7:
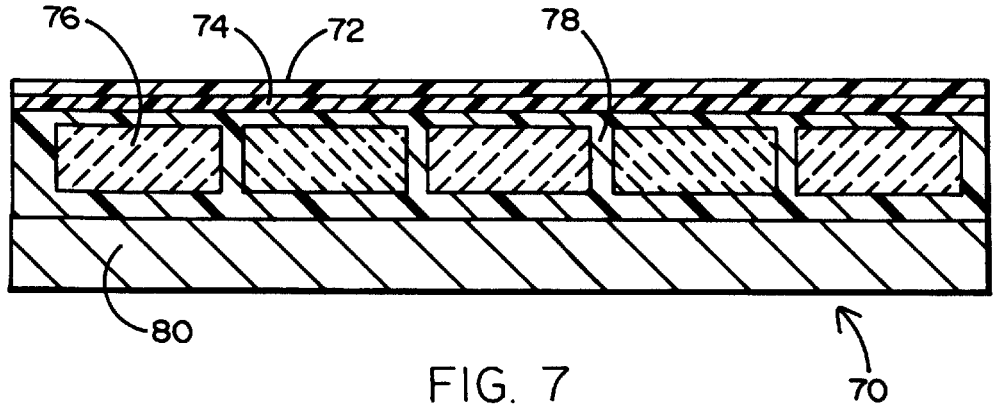
Figure 8:
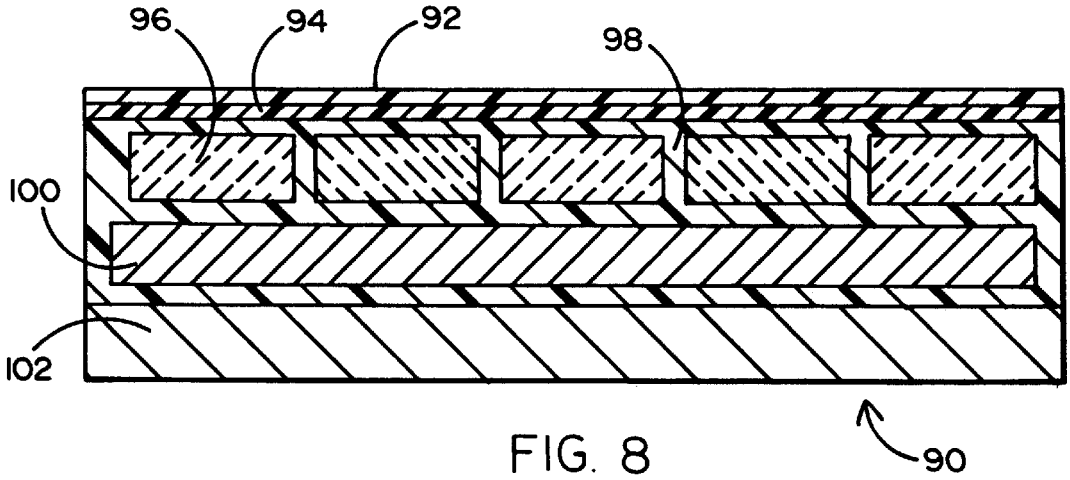

An embodiment of the invention in the form of skirt armor (a self-contained hinged configuration) is shown in FIG. 5. The illustrated embodiment 30 provides protection against a projectile 32 and comprises a surface rubber 34 (as used herein "elastomer" and "rubber" are at least equivalent), a spall shield 36, interior rubber 38, ceramic tiles 40, backing 42 and an attachment device 44. The surface rubber and interior rubber are preferably of different properties as will be explained further hereinafter. The spall shield is designed to "catch" fragments. The tiles 40 and the backing plate 42 are fully encapsulated by the interior rubber 38. FIGS. 6, 7, and 8 illustrate three alternative embodiments of side armor constructed in accordance with the present invention. In FIG. 6, armor 50 comprises surface rubber 52, spall shield 54, tiles 56, interior rubber 58, and backing 60 attached to an underlying structure 62. In this embodiment, only the tiles 56 are encapsulated by interior rubber 58. The backing is affixed directly to the underlying structure.

In FIG. 7, armor 70 comprises surface rubber 72, spall shield 74, tiles 76, interior rubber 78, all attached to the underlying structure 80 without a backing plate.

In FIG. 8, armor 90 comprises surface rubber 92, spall shield 94, tiles 96, interior rubber 98 and backing plate 100 attached through interior rubber 98 to an underlying structure 102. In this configuration, the tiles and the backing plate are fully encapsulated.

Figure 9:
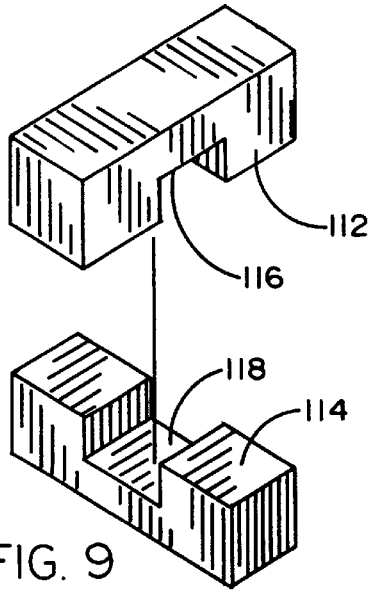
FIGS. 9 and 10 are three-dimensional views of a corner shim used in another embodiment of the invention.
Figure 10:
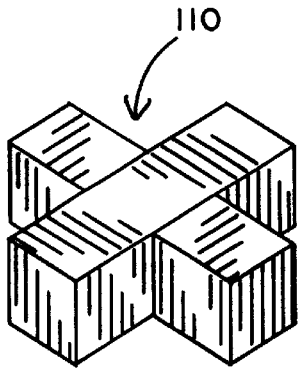
Figure 11:
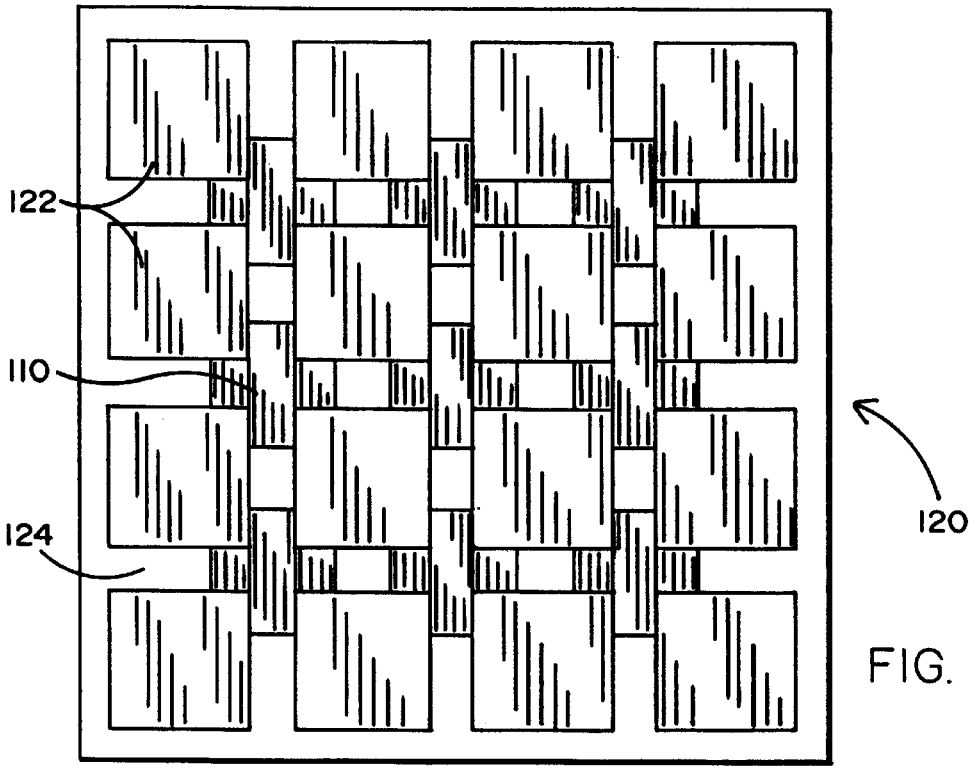
FIGS. 11 and 12 are elevational and side views respectively of an array using the shims of FIGS. 9 and 10.
Figure 12:
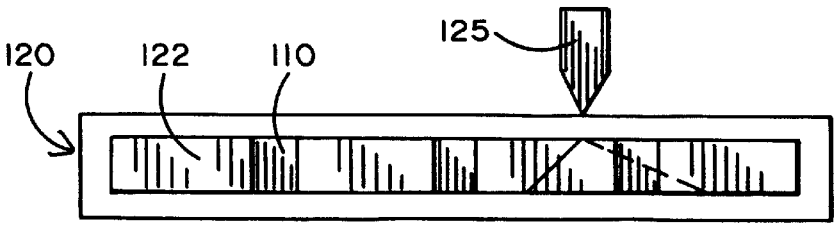

In still another embodiment of the invention, cross-shaped corner shims are used to further control shock propagation from the corner of one tile to the corner of another tile. This configuration is explained in FIGS. 9–12. In FIGS. 9 and 10, it will be seen that a corner shim 110 comprises first and second shim members 112 and 114. Each shim member comprises a mating slot 116,118 where they may be joined in overlapped, slot-to-slot relation to form the cross-shaped corner shim 110. As shown in FIGS. 11 and 12, in an array armor embodiment 120, a plurality of ceramic tiles 122, encapsulated by an interior elastomer 124, are separated at their respective corners by a plurality of cross-shaped corner shims 110. The shims are preferably made of hardened steel which has an impedance closely matching the impedance of SiC ceramic from which the preferred tiles are made. In this manner, a projectile 125 hitting near a corner will not significantly damage an adjacent tile despite a corner hit. Shims 110 may be employed during fabrication by serving as tile array dividers during elastomer encapsulation.

Figure 13:
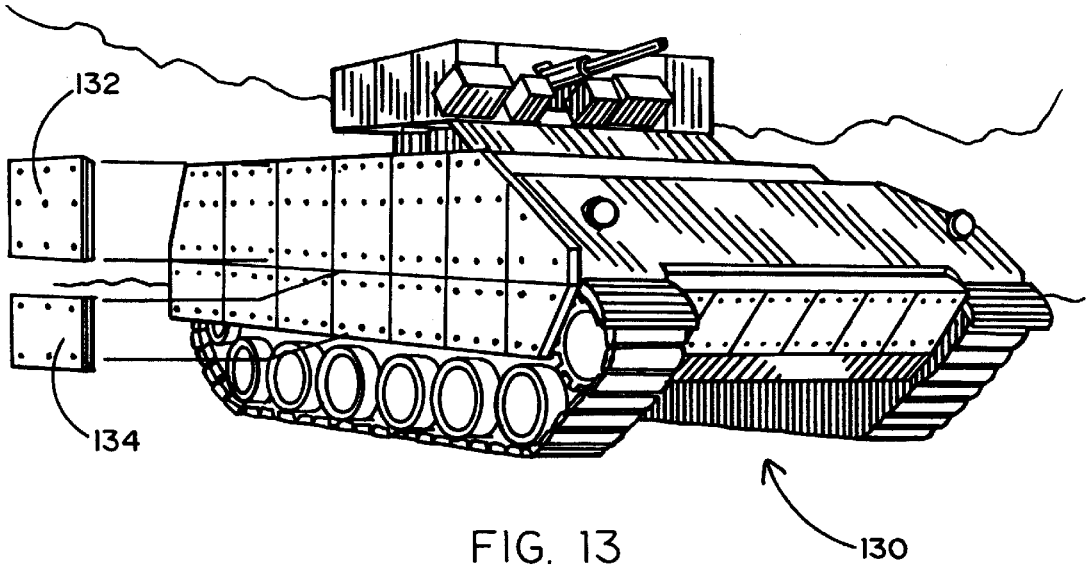
FIGS. 13 and 14 are three-dimensional exploded views of alternative installations of the arrays of the invention on a tank body.
Figure 14:
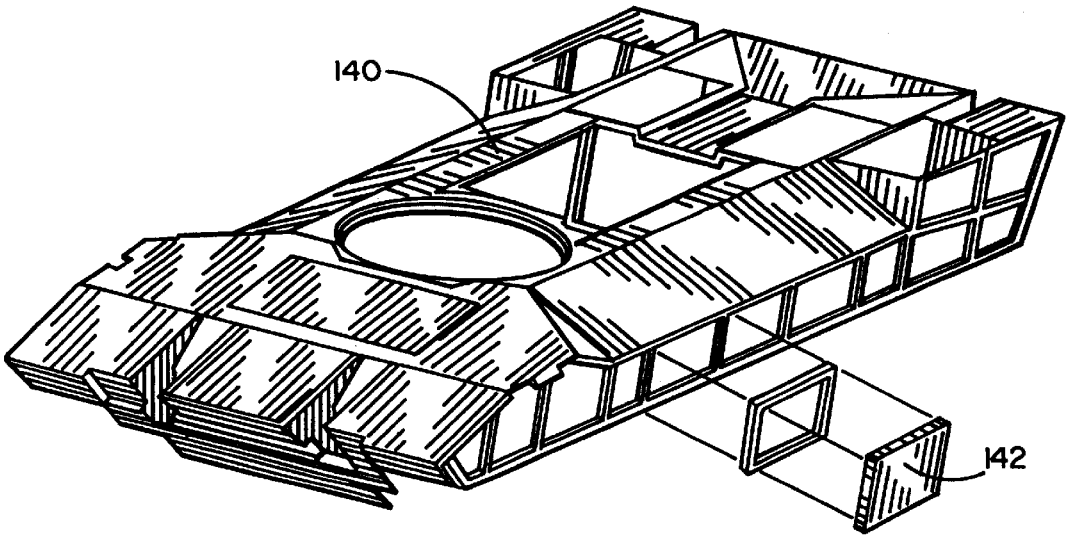

The manner in which one or more of the disclosed embodiments may be used to protect a structure such as a tank or other military vehicle, is shown in FIGS. 13 and 14. In FIG. 13, side armor plate 132 and skirt armor plate 134 provide exterior protection on a Bradley vehicle wherein the underlying structure provides full support for the armor. In FIG. 14, side armor 142 provides protection on a AAAV wherein the underlying structure provides frame support for the armor.

Silicon carbide (SiC) was chosen as the ceramic material because of its lower cost and good ballistic weight efficiency. To enhance the multi-hit capability at a high protection probability, it was decided to use 3-inch square SiC tiles in the preferred embodiments.

Alloy 5083 Al was selected as the backing component because of its excellent performance as the backing material for ceramic armors. This alloy has the following properties (see Metals Handbook Vol. 1, ASM):

Density: 2.66 g/cm$^3$

Tensile Strength: 42,000 psi

Yield Strength: 21,000 psi

Elongation: 22%

Composition: 4.5% Mg, 0.7% Mn

This grade of aluminum has been used for various vehicular structures and armors, including those on the M113 Armored Personnel Carrier and the M2 Bradley Fighting Vehicle. Another factor which influenced its selection is that 5085 Al exhibits a simple elastic/plastic-work hardening deformation behavior (constitutive relation). The out-of-plane deformations measured on the backing plates after ballistic testing represent nearly the entire, maximum out-of-plane excursion which the backing plate suffered during defeat of the threat. This elastic/plastic-work hardening behavior allows understanding the maximum dynamic response of the backing plate without having to resort to additional diagnostic instrumentation. On the contrary, polymer composite backing plates have complex viscoelastic characteristics. The post-test, out-of-plane deformations measured on polymer composite backing plates do not necessarily represent the maximum deformations which were produced dynamically during the impact event. The multiple hit performance of an armor system is strongly dependent on the damage created from previous hits. Assessment of the level of damage produced in both the ceramic and the backing components by the first hit is very important.

The selection of elastomers was based on the following properties: dynamic impedance, elongation to failure, strength, toughness and viscoelastic behavior in the strain rate range of $10^2$ to $10^4$ $s^{-1}$. The glass transition temperature of an elastomer is an important physical property which gives some indication of its rheology under dynamic loading conditions and its change in behavior (rubbery vs. glassy) with temperature. The dynamic toughness, strength and ductility of the elastomer give indication of its ability to accommodate the lateral expansion of the fractured ceramic tiles and the deflection of the backing plate. After reviewing and examining the available elastomers, polysulfides were selected. Polysulfides have been widely used as a sealing compound for fuel tanks, as specified by MIL-S-8802F. It has the following physical properties:

Shore Hardness: 50

Tensile Strength: 300 psi

Elongation: 350%

Glass Transition Temperature: −65° F.

There are several first-order parameters associated with the design of elastomer encapsulated armor packages, including: tile size, inter-tile web dimension, elastomer thickness on top and bottom, and the areal densities of the ceramic and aluminum backing components. An experimental matrix was designed to investigate the armor performance and the dynamic response of the targets by testing different areal densities of the ceramic and backing components at the threat velocity of interest and holding all other design parameters fixed.

The specimen configuration of the large panels had 16 SiC tiles, with two types of rubber. The gap between ceramic tiles was kept at 0.040±0.005".

There are two casting processes, requiring two separate casting molds. The first mold was used to locate the individual tiles and the second mold was employed for the full encapsulation. SiC tiles were first loaded into the first mold with precision dividers. The surface rubber layer and the Kevlar spall shield were laid on the top of the SiC tiles. Pressure was a applied on individual SiC tiles to ensure the good bonding. After the first casting process, all SiC tiles were bonded to the surface rubber layer. This assembly was then placed into the second mold and vulcanized under pressure. After the elastomer-encapsulated package is removed from the mold, the fabrication of the elastomer-encapsulated armor package was completed. The elastomer-encapsulated ceramic armor component is then bonded to 5083 Al backing.

To successfully commercialize this elastomer-encapsulation technology, low-cost, high-volume rubber materials and manufacturing processes are preferred. Two grades of elastomers are needed: surface rubber to protect against the non-ballistic battlefield environment and interior rubber which will control the dynamic response of the armor system produced by impact and will protect ceramic tiles around the hit. Schemes of molding should effectively incorporate as-manufactured, larger dimensional tolerance ceramic tiles in an armor system array.

The manufacture of these armors consists of (1) ceramic tile fabrication, (2) elastomer encapsulation of a tile array, and (3) attachment of the encapsulated array to the backing plate of the armor. Ceramic processing includes powder blending, hot pressing and final diamond grinding. If the methods used to construct the armor can accommodate large tolerances in the ceramic tile dimensions, the ceramic fabrication costs can be significantly reduced; i.e., final diamond grinding will not be required. However, large variations in the tile dimensions impose additional technical challenges to the elastomer encapsulation step.

Based on the method by which the armor is supported in the application, the armor mounting can be classified as (1) complete support, (2) edge support, and (3) hinged support. In vehicles such as AMV which has a space frame construction, the armor is edge supported on the frames. Vehicles such as Bradley Fighting Vehicle support the armor with the thick vehicle hull; these are completely supported armor packages. There are many potential applications for these two types of armor systems, including door armors for 5 ton trucks, PLS door armors, armors for the protected troop transporters, compartment armors and turret armors on HMMWV. A skirt armor is an example of the hinged support system. The armor is attached to the structure on the upper edge and the armor is able to swing. The impact force can be transmitted to the vehicle only through the upper edge.

Three different armor constructions are applicable, depending on the location of the backing material: (1) an elastomer-encapsulated component mounted on a backing plate, (2) an elastomer-encapsulated component onto a structure directly without using the backing plate, and (3) an encapsulated component with an incorporated backing plate. 5083 Al alloy was used as the backing material for the preliminary study. Other backing materials, such as Kevlar, Spectra and fiberglass can be used, depending on the application, the operating environment of the armor and the demands made on the armor. In some applications, the structure, such as the vehicle hull, can support the ceramic hard-face and the elastomer-encapsulated ceramic component can be directly attached to the structure, without the backing plate. The backing material can be encapsulated during the elastomer process and this type of package can certainly provide some unique advantages in the attachment process. For example, if Kevlar backing is incorporated in the elastomer process, the resulting armor packages provide the flexibility in bending so that they can be readily used on the curved roofs of Quonset huts or other non-flat structures.

The ballistic performance of the elastomer-encapsulated ceramic component is strongly dependent on design parameters, including the areal density of the ceramic tiles and backing, the selection of the ceramic and backing materials, the size of the ceramic tiles, the inter-tile dimension between ceramic tiles, the thickness of the it elastomer above and beneath the ceramic tiles, the types of spall shield (Keviar, Nylon, i1i Spetra, etc.) and the types of elastomers (silicones, polysulfides, polyurethanes, natural rubbers, etc.). Among these factors, the gap dimension between ceramic tiles and the areal density of the ceramic tiles will affect the most vulnerable area of the array: the area near to the inter-tile gaps. This area may be the most critical performance limiting feature of the armor. This gap must be large enough for the filling elastomer to exhibit the dynamic functions: attenuating stress waves, accommodating lateral displacement and isolating adjacent tiles. However, this gap needs to be minimized to reduce the vulnerability to complete penetration. In one embodiment, the gap was fixed at 0.040±0.005", using ceramic tiles with ±0.002" tolerance. To achieve the overall low cost process, ceramic tiles with larger tolerances should be used and the tolerance of the gap may also increase.

The multi-hit performance of an armor package is influenced by the damage after the first shot, which is significantly dependent on the areal density of both the ceramic component and the backing component. Different materials will have different required areal density. The selection of the ceramic areal density may also affect the required gap width because the character of the stress wave propagation and the force distribution after ceramic comminution are influenced by the areal density.

Figure 4:
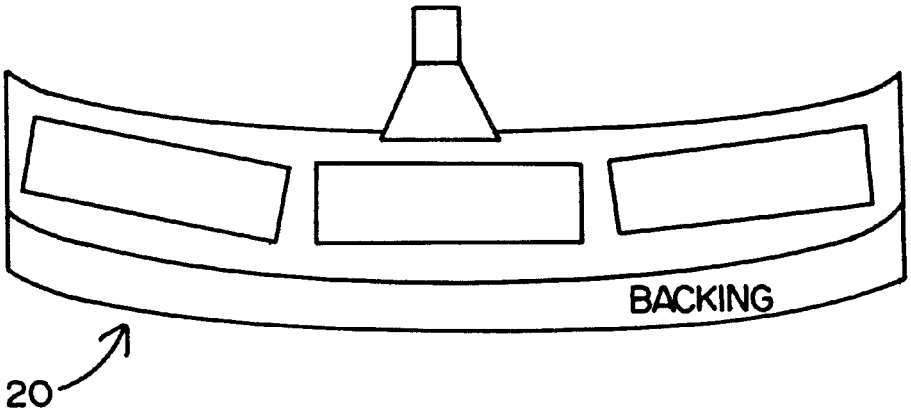

A multi-layered elastomer approach is used in the preferred embodiment. FIG. 4 shows a diagram of a skirt armor in which two surface rubbers sandwich the interior rubber. The surface rubber provides the resistance against the battlefield environment, and the interior rubber has the required dynamic properties to absorb the shock waves, to accommodate the lateral displacement associated with the ceramic fracture and to dynamically isolate the adjacent ceramic tiles during the backing vibration. The interface between these two different grades of elastomer should be strong and free of voids.

The mechanical properties of elastomers are dependent on their temperature. It is preferable in military applications to provide the elastomer-encapsulated ceramic armor components which will function properly in an ambient temperature range between −60° F. and +160° F. In this temperature range the elastomer should maintain its rubber behavior. Physical and mechanical properties, such as glass transition temperature, melting point, dynamic modulus, strength, elongation, hardness and environmental compatibility need to be acceptable over this range of temperatures for battlefield use.

Having thus disclosed a number of alternative embodiments of the invention, it being understood that many modifications and additions are contemplated and will now occur to those having the benefit of the present disclosure, what we claim is:

1. An armor plate for resisting penetration by incident high speed projectiles; the armor plate comprising:

a plurality of ceramic tiles arrayed along a common surface, the tiles being spaced from one another; each of said tiles being individually encapsulated in a flexible restraining material for attenuating shock impact and limiting lateral displacement of tiles adjacent a tile hit by a first of said incident high speed projectiles for maintaining penetration resistance against subsequent incident high speed projectiles.

2. The armor plate recited in claim 1 wherein said common surface is planar.

3. The armor plate recited in claim 1 wherein said flexible restraining material is an elastomer.

4. The armor plated recited in claim 1 wherein said ceramic tiles are made of silicon carbide.

5. The armor plate recited in claim 1 wherein said ceramic tiles are arrayed in a rectangular configuration.

6. The armor plate recited in claim 1 further comprising an exterior elastomer coating.

7. The armor plate recited in claim 1 further comprising a backing plate to which said encapsulated arrayed tiles are bonded.

8. The armor plate recited in claim 7 wherein said backing plate is also encapsulated in a flexible restraining material.

9. The armor plate recited in claim 7 wherein said backing plate is made of a metal.

10. The armor plate recited in claim 9 wherein said metal is aluminum.

11. The armor plate recited in claim 1 wherein said tiles have adjacent corners and further comprising a plurality of corner shims located between said tiles at said adjacent corners.

12. The armor plate recited in claim 1 wherein said corner shims are made of metal.

13. The armor plate recited in claim 12 wherein said shim metal is steel.

14. The armor plate recited in claim 11 wherein each of said corner shims is cross shaped.

15. An armor plate for resisting penetration by incident high speed projectiles; the armor plate comprising:

a plurality of individually elastomer encapsulated rectangular ceramic tiles arranged in spaced relation along a common surface and a backing plate to which said encapsulated tiles are commonly bonded.

16. The armor plate recited in claim 15 further comprising an exterior elastomer enclosing said encapsulated tiles and said backing plate.

17. The armor plate recited in claim 15 wherein said common surface is planar.

18. The armor plate recited in claim 15 wherein said ceramic is silicon carbide.

19. The armoolate recited in claim 15 tberein said backing plate is made of aluminum.

20. The armor plate recited in claim 15 further comprising corner shims between adjacent tiles.

* * * * *

UNITED STATES PATENT AND TRADEMARK OFFICE

CERTIFICATE OF CORRECTION

PATENT NO. : 6,532,857 B1 
DATED : March 18, 2003
INVENTOR(S) : Chienchung James Shih and Marc A. Adams It is certified that error appears in the above-identified patent and that said Letters Patent is hereby corrected as shown below:

Title page,
Item [57], ABSTRACT, please insert
-- ORIGIN OF INVENTION
This invention described herein was made with Government support under Contract No. DAAE07-99-C-L028 awarded by the United States Army and under which the Contractor has elected to retain title. --

Signed and Sealed this

Second Day of December, 2003

JAMES E. ROGAN
*Director of the United States Patent and Trademark Office*